United States Patent [19]

Knudsen

[11] 4,198,901

[45] Apr. 22, 1980

[54] MACHINE FOR GRIPPING AND SIZING CONTAINERS FORMED FROM FLEXIBLE MATERIAL

[75] Inventor: David S. Knudsen, St. Louis, Mo.

[73] Assignee: McKenna Equipment Company, Inc., Pacific, Mo.

[21] Appl. No.: 869,262

[22] Filed: Jan. 13, 1978

[51] Int. Cl.[2] ..... B31B 17/74

[52] U.S. Cl. ..... 93/55.1 M; 53/314; 93/36 SQ

[58] Field of Search ..... 93/36 SQ, 55.1 N, 55.1 R, 93/53 SD; 53/186, 313–315, 564, 579; 198/653, 654, 655

[56] References Cited

U.S. PATENT DOCUMENTS

| | | | |
|---|---|---|---|
| 2,486,893 | 11/1949 | Van Doren | 93/55.1 N |
| 2,935,918 | 5/1960 | Goss | 53/186 X |
| 3,039,248 | 6/1962 | Jones | 53/186 X |
| 3,040,635 | 6/1962 | Engelson et al. | 53/186 X |
| 3,332,209 | 7/1967 | Knudsen | 53/313 |
| 3,454,142 | 7/1969 | Holstein | 198/162 |
| 4,024,693 | 5/1977 | Leasure et al. | 53/186 |
| 4,095,390 | 6/1978 | Knudsen | 53/39 |

*Primary Examiner*—Roy Lake
*Assistant Examiner*—Eugene F. Desmond
*Attorney, Agent, or Firm*—Gravely, Lieder & Woodruff

[57] ABSTRACT

A machine for bringing the flexible upright walls of paperboard containers into a predetermined configuration, so that fitment rings may be applied to the upper ends of those containers, includes a pair of captivator chains having parallel inner passes and a main conveyor located generally between the two inner passes. The containers are released onto the main conveyor at equal intervals, whereupon opposed captivator blocks on the two chains fit snugly around the containers and cause them to assume the desired configuration. This enables fitment rings to be installed over the upper margins of the sidewalls or some other operation to be performed on the containers.

21 Claims, 11 Drawing Figures

FIG.1
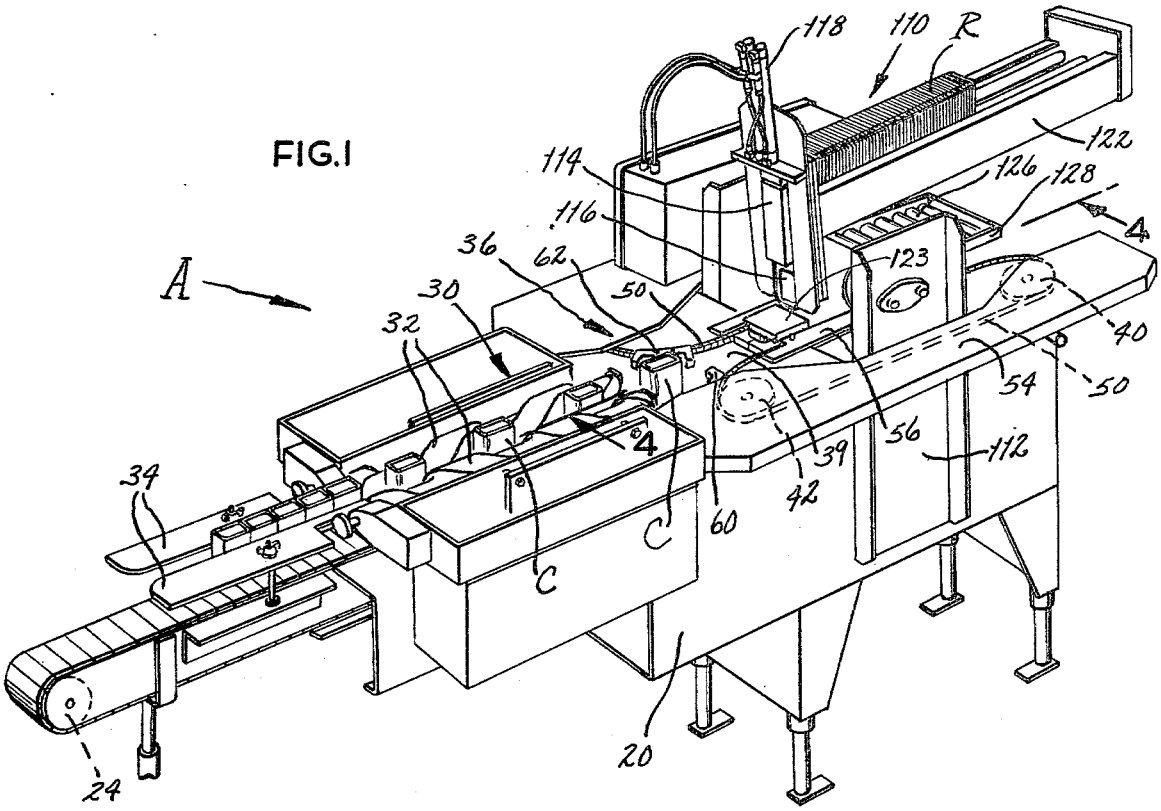
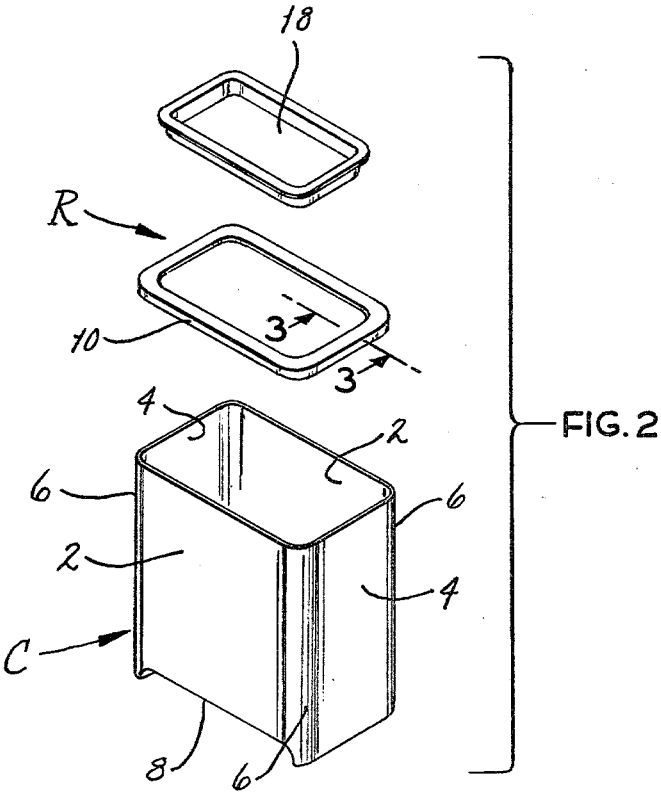
FIG. 2
FIG.3
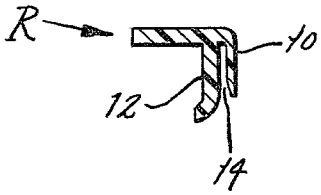

MACHINE FOR GRIPPING AND SIZING CONTAINERS FORMED FROM FLEXIBLE MATERIAL

BACKGROUND OF THE INVENTION

This invention relates in general to machines utilized in packaging operations, and more particularly a machine for maintaining flexible sidewalls of a container in a predetermined configuration, so that some other operation may be performed on the container.

Many food and other products are packaged in composite containers composed of paperboard side walls and metal or plastic end walls. Usually these containers are assembled by the container manufacturer, at least to the extent that the contents may be introduced into them. For example, the container manufacturer may ship the container to the packager with a bottom wall attached to the paperboard side walls, but with top wall detached. After filling the container, the packager attaches the top wall. Sometimes, the top wall has a large opening fitted with a removable cap, as is the case of powdered cocoa and tea containers, and in that situation the container manufacturer assembles the entire container, except for the cap which is applied by the packager.

In any event, the present procedure necessitates shipping erected containers which, although light in weight, consume considerable space. Consequently transportation expenses are high.

To reduce transportation expenses, procedures and special machines now exist for enabling the packager to erect the containers. The container manufacturer in this instance supplies paperboard blanks, which are shipped to the packager flat. The container manufacturer also provides a machine for transforming the flat blanks into open top containers. The machine folds each blank and glues its margins to provide a container of rectangular configuration, with the four side walls and the bottom wall being intergral. Thereafter, a plastic fitment ring is attached to the upper margin of the container, and this ring has a large opening capable of receiving a plastic cap. No machine has yet been developed for efficiently applying the fitment ring to the upper margin of the container.

The difficulty in applying the fitment ring is attributable primarily to the flexibility of the paperboard. In this regard the fitment ring has a downwardly opening groove into which the upper edge of the paperboard container fits. Once the fitment ring is in place, both ends of the container are quite rigid, notwithstanding the flexibility of the paperboard itself, for the lower end is rigidified by the integral bottom wall, while the upper end is rigidified by the fitment ring. The problem resides in bringing the flexible upper margin of the container into a configuration which corresponds precisely to that of the groove in the fitment ring and maintaining the upper margin in that configuration as the fitment ring is applied.

SUMMARY OF THE INVENTION

One of the principal objects of the present invention is to provide a machine for maintaining the upper ends of flexible containers in a predetermined configuration so that rigidifying devices may be applied to them or so that some other operation may be performed on them. Another object is to provide a machine of the type stated for rapidly applying closures or other ridifying devices to the ends of containers having flexible sidewalls. A further object is to provide a machine of the type stated which is suitable for use along a filling line in that it applies the ridifying devices as the containers move along the line and without interrupting the movement. An additional object is to provide a machine of the type stated which completely captivates the containers near their upper ends as the rigidifying devices are applied. Still another object is to provide a machine of the type stated which is suitable for use with paperboard containers, even paperboard containers which are quite deep and are formed from relatively thin paperboard. Yet another object is to provide a machine of the type stated which externally capativates preformed paperbord containers so that the rigidifying device may be applied to them. These and other objects and advantages will become apparent hereinafter.

The present invention is embodied in a machine including a conveying path; an endless conveying device along the path; drive means for moving the endless device; and captivator blocks on the endless device. The captivator blocks are segmented, and both the blocks and the endless device are configured such that the blocks move from an open position to a closed position as they approach conveying path so as to snugly grip containers on the path. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 1 is a perspective view of a machine for gripping and sizing containers formed from flexible material;

FIG. 2 is an exploded perspective view showing the erected container, the fitment ring which is applied by the machine, and a cap that fits into the fitment ring;

FIG. 3 is a sectional view taken along line 3—3 of FIG. 2 and showing the cross-sectional configuration of the fitment ring;

DETAILED DESCRIPTION

Figure 4:
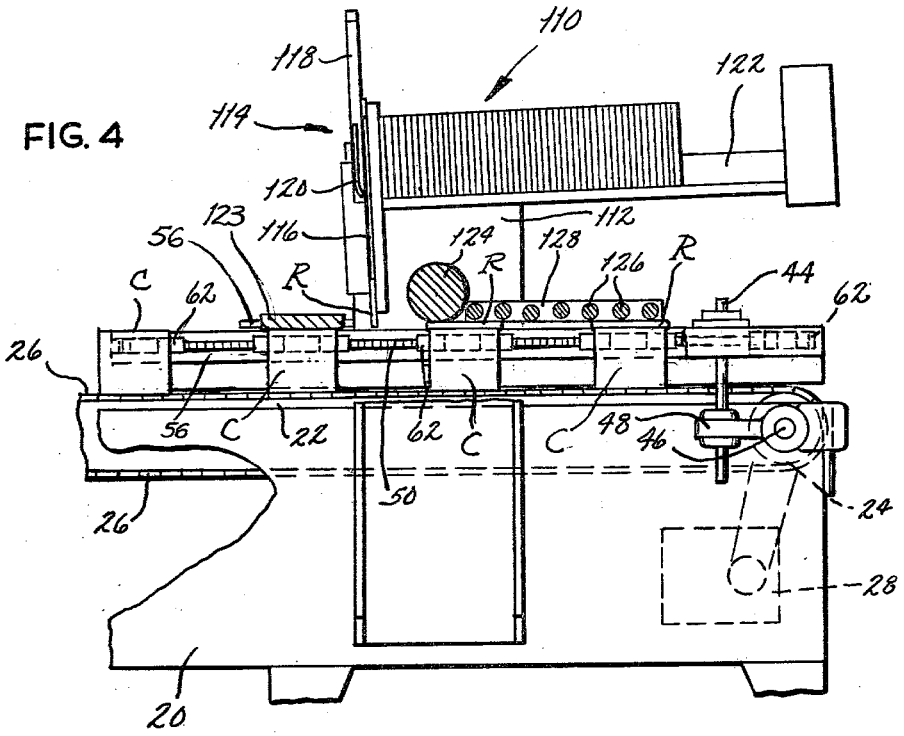
FIG. 4 is a sectional view taken along line 4—4 FIG. 1.

Referring now to the drawings, A designates a machine for applying fitment rings R to the upper ends of paperboard containers C in rapid succession so as to rigidify the upper ends of the containers C (FIG. 1). Each container C is formed wholly from paperboard, which by its very nature is quite flexible, and includes (FIG. 2) parallel side walls 2, parallel end walls 4 which are joined to the side walls 2 at curved corners 6 and a bottom wall 8 which is joined to the side and end walls 4 and 6 so as to close the lower end of container C. The end walls 4 are somewhat narrower than the side walls 2 and are arranged perpendicular to them so as to impart a rectangular cross-sectional shape to the container C. The container C is formed from a single paperboard blank on a machine, but neither the blank nor the machine constitute part of the present invention and will therefore not be discussed in detail.

The fitment ring R (FIGS. 2 & 3) fits over the upper margins of the side and end walls 2 and 4 on the container C and has a depending exterior flange 10 and a lip 12 which is spaced inwardly from the flange 10 so as to form a downwardly opening groove 14 between the flange 10 and the lip 12. The groove 14 possesses the same size and configuration as the upper end of the container C, and indeed when the ring R is in place, the upper edges of side walls 2, the end walls 4, and the contoured corners 6 are in the groove 14. Thus, the walls 2 and 4 and the corners 6 at their upper ends are captured between the flange 10 and the lip 12 in a rectangular configuration and cannot flex out of that configuration. The lip 12 is somewhat deeper than the flange 10 and below the flange its outwardly presented surface is curved so as to impart a slight bevel to the lower end of the lip 12. The ring R has a large opening 16 suitable for receiving a lid or cap 18 which may be pressed into and pried out of ring R. However, the cap 18 is not in the ring R when the ring R is initially installed on the container C. Either the upper margins of the walls 2 and 4 and corners 6 on the container C or the surface of the groove 14 in the ring R have an adhesive coating on them, and preferably the adhesive is heat sensitive. It should also be compatible with both the plastic of the ring R and the paperboard of the side and end walls 2 and 4.

The machine A includes (FIGS. 1 & 4) a main frame 20 having a skid plate 22 extending for substantially its entire length. At the ends of the skid plate 22 are sprockets 24 around which a main conveyor chain 26 passes, and this chain is preferably of the table top variety, that is, it is composed of a succession of individual plates which are joined together by pins. The inwardly presented surfaces of the plates are configured to engage the sprockets 24, while the outwardly presented surfaces are perfectly flat so that the succession of plates resting on the skid plate 22 presents a planar and horizontal conveying surface or path. The upper pass of the chain 26 has a feed end and a discharge end and the sprocket 24 at the discharge end is powered by drive motor 28 located on the frame 20, with the direction of rotation being such that the upper pass of the main conveyor chain 26 moves from the feed end to the discharge end. Containers C without the fitment rings R are placed on the feed end of the chain 26.

At the end of the chain 26, the main frame 20 supports a spacing mechanism 30 (FIGS. 1 & 5) including a pair of counterrotating feed screws 32, the axes of which are parallel to each other and also to the upper pass of the chain 26. One screw 32 extends along one side of the chain 26, while the other extends along the opposite side. The roots of the screws 32 are wide enough to accommodate the side walls 2 on a container C, and the two screws 32 are synchronized such that their roots are located opposite each other across the conveyor chain 26. The spacing between the two screws 32, measured at the roots, is slightly greater than the width of the container C. Thus, a container C supported on the chain 26 with its side walls 2 parallel to the direction of advance for the chain 26 will fit in the opposed roots of the two screws 32 so as to be confined at its sides by the screws 32. The screws are mechanically connected to the drive motor 28 on the frame 20 and rotate at a speed sufficient to advance the containers at about the velocity of the conveyor chain 26. Leading up to the feed ends of the screws 32 are two guide members 34, the spacing between which is only slightly greater than the width of the container C. The screws 36 serve to space the containers C at equal intervals along the chain 26, while the guide members 34 align the containers C with the feed ends of the screws 32. The underlying conveyor chain 26, by virtue of its movement, urges containers C successively against the feed ends of the screws 32, whereupon they are advanced.

Figure 5:
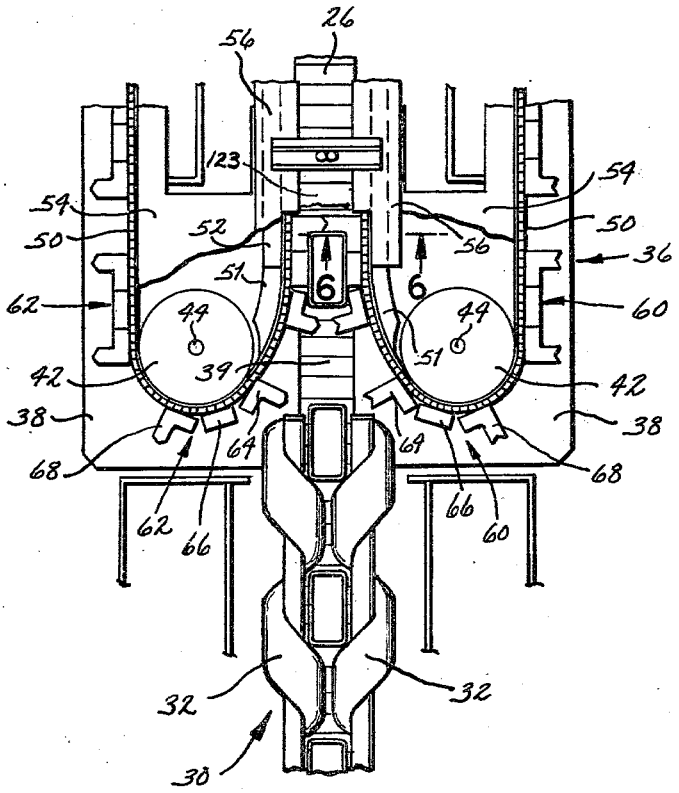
FIG. 5 is a fragmentary plan view, partially broken away, showing the captivator mechanism at the location where the containers are released into it.
Figure 6:
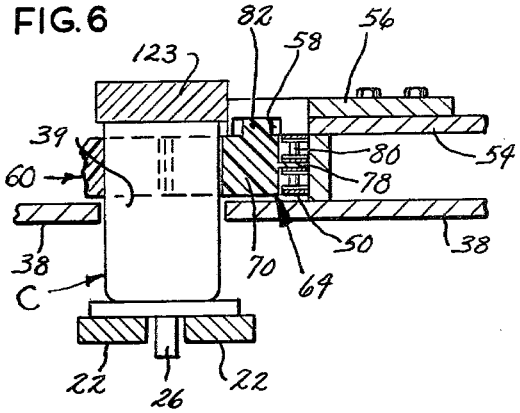
FIG. 6 is a sectional view taken along line 6—6 FIG. 5 and showing the leading segment of captivator block engaged with the guide plate that maintains its lateral position.

Immediately beyond the spacing mechanism 30, the frame 20 supports a captivator mechanism 36 (FIGS. 1 & 5) which firmly grips the individual containers C at their upper ends and sizes them as the fitment rings R are applied. The captivator mechanism 36 includes a separate base plate 38 attached to the frame 20 on each side of the conveyor chain 28, with each plate 38 being elevated above the chain 26 (FIG. 6). The inner margins of the two plates are parallel to each other and to the direction of advance for the chain 26, and those margins form a conveying channel 39 which leads away from the spacing mechanism 30. The channel 39 is only slightly wider than the width of the containers C. Located above each base plate 38 is a drive sprocket 40 and an idler sprocket 42 (FIGS. 1 & 5), both of which are mounted on vertical shafts 44 (FIG. 44) that extend through bearings mounted on plate 38. The drive sprockets 40 are located ahead of the idler sprockets 42 in terms of the direction of advance for the containers C, and their drive shafts 44 are connected to a common cross shaft 46 through right angle drives 48. The cross shaft 46 in turn is connected to the drive motor 28. The drive and idler sprockets 40 and 42 on each side of the conveying channel 39 have captivator chains 50 extended around them. Actually, each sprocket 40 or 42 is a dual sprocket, and each chain 50 is of the dual configuration being composed of one chain on top of another chain (FIG. 6).

While the outer passes of the chains 50 extend straight between the two sprockets 40 and 42, the inner passes move along a curved backing bar 51 (FIG. 5) that imparts a curvature to the chain 50 immediately beyond the idler sprocket 42, with the curvature having a radius greater than that of the sprocket 42. The curved backing bar 51 merges into a straight backing bar 52 that parallels side edge of the main conveyor 26. Another curved backing bar 51 exists at the approach of the inner pass to the drive sprocket 40. The backing bars 51 and 52, of course, position the inner passes of the two captivator chains 50 with respect to the conveying channel 39 and prevent those passes from bowing away from the channel 39.

The drive motor 28 is connected positively to the common cross shaft 46 such that the speed at which the two drive sprockets 40 rotate propels the captivator chains 50 at substantially the same velocity as the main conveyor chain 26. Moreover, the inner passes of the two chains 50 move along the conveying channel 39 in the same direction as the conveyor chain 50, that is away from the spacing mechanism 30.

Each base plate 38 is covered for the most part by a cover plate 54 which also encloses the drive and idler sprockets 40 and 42, the captivator chain 50, and the backing bars 51 and 52. Fastened to each cover plate 54 is a guide plate 56 (FIGS. 5 & 6) having a guide way in the form of a downwardly opening guide channel 58 set slightly inwardly from, but yet parallel to, the inner pass of the chain 50. The entrance to the guide channel 58 is somewhat wider than the remainder of the channel 58. The guide channels 58 exist only along the straight backing bars 52.

Figure 7:
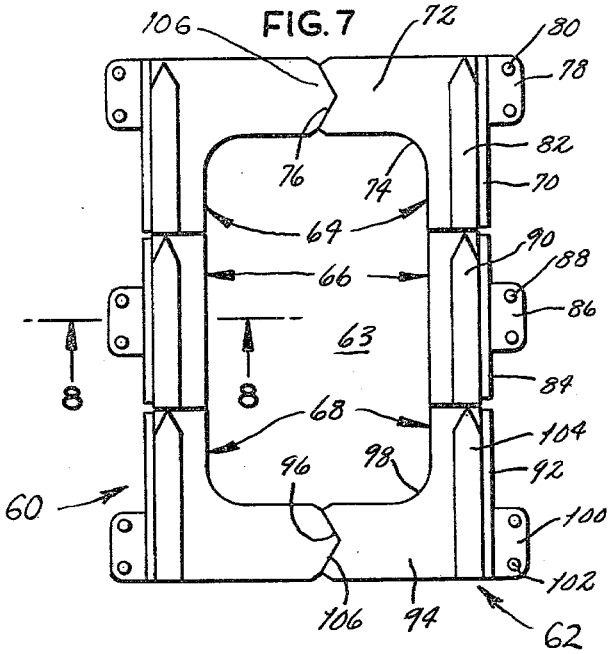
FIG. 7 is a plan view of a pair of corresponding captivator blocks fitted together in a configuration suitable for snugly gripping a container.
Figure 8:
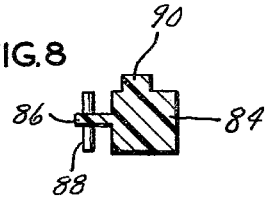
FIG. 8 is a sectional view taken along line 8—8 of FIG. 7.

The captivator chain 50 on the right side of the conveying channel 39 carries captivator blocks 60 (FIG. 5) which project laterally therefrom at equally spaced intervals. Likewise, the captivator chain 50 on the left side of the channel 39 carries an equal number of captivator blocks 62. The two chains 50 are synchronized such that as a block 60 comes around the idler sprocket 42 for the right chain 50, a corresponding block 62 will come around the idler sprocket 42 for the left chain 50, and shortly thereafter the two blocks 60 and 62 will merge and close upon each other over the conveying channel 39 (FIG. 9). Each pair of corresponding blocks 60 and 62 when closed upon each other forms a cavity 63 (FIG. 7) that precisely corresponds in size and shape to the upper end of the containers C. In addition to being synchronized with each other, the chains 50 are further synchronized with the feed screws 32 of the spacing mechanism 30, so that the feed screws 32 release each container C into the space between the closing captivator blocks 60 and 62. In this regard, the feed screws 32 are long enough to maintain positive control over the containers C until the containers C are actually in the diminishing space between closing captivator blocks 60 and 62. Immediately, thereafter the upper end of each container C is firmly captured in the cavity 63 between the two blocks 60 and 62, and the blocks 60 and 62 size the flexible upper ends of the containers C, placing each in a configuration suitable for reception of a fitment ring R.

Each block 60 or 62 is actually three separate segments which enable the block 60 or 62 to articulate as it rounds its idler sprocket 42 and the curved backing of bar 52 located immediately beyond the sprocket 42. In particular, the captivator block 60 consists of a leading segment 64, an intermediate segment 66, and a trailing segment 68 arranged in that order in the direction of advance (FIG. 5). Since the segments 64, 66, and 68 for corresponding blocks 60 and 62 are substantially the same, only the segments 64, 66, and 68 for the blocks 60 will be described in detail.

The leading segment 64 for the block 60 (FIG. 7) possesses an L-shaped configuration and includes a side leg 70 which extends along the captivator chain 50 and a cross leg 72 which projects laterally from the chain 50, it being disposed at a right angle with respect to the side leg 70. The two legs 70 and 72 are formed integral with each other and have planar inside surfaces which equals the radius of contoured corners 6 on the container C. The end of the cross leg 72 is located about at the center of the conveying channel 39 and is provided with a recess 76 which may be V-shaped or some other suitable configuration such as arcuate. The side leg 70 at its forward end is provided with a mounting tab 78 which projects laterally therefrom into the space between the two individual chains of the dual captivator chain 50 (FIG. 6). The tab 78 is no longer than an individual link of the chain 50 and is connected to the chain 50 by two adjacent pins 80 which hold successive links of the chain 50 together. Thus, the leading segment 64 remains fixed in position with respect to the chain link to which it is attached, but the other chain links are free to shift or move relative to it, and this occurs as the chains 50 pass around the drive and idler sprockets 40 and 42 and along the curved backing bar 51. The side leg 70 further has a guide boss 82 which projects upwardly from its upper surface and is received in the guide channel 58 (FIG. 6) of the guide plate 56 when the leading segment 64 is along the straight backing bar 52. The leading end of the guide boss 82 is tapered to facilitate entry of the boss 82 into the guide channel 58. The trailing surface of the side leg 70 is planar.

The intermediate segment 66 (FIG. 7) has a single straight leg 84 which aligns with the side leg 70 of the leading segment 64. Indeed, the inside surfaces of the two legs 70 and 84 are planar and perfectly flush when the block 60 is along a straight backing bar 52. The outside surface of the straight leg 84, on the other hand, has a mounting tab 86 projected from it into the space between the two individual chains of the dual captivator chain 50. The tab 86 is centered between the ends of the intermediate segment 66 and is secured to the chain by adjacent link pins 88. Like the tab 78, the tab 86 is no longer than a single link of the chain 50, so that it is fixed in position with respect to the chain link to which it is attached, but is free to move with respect to the other links. Projecting upwardly from a single leg 84 is a guide boss 90 which has a tapered leading end. The boss 90 is equal in width to the boss 82 on the leading segment 64 and follows that boss into the guide channel 58. Both the leading and trailing ends of the single leg 84 are planar and the former is located almost in abutment with the planar trailing end of the side leg 70 on the leading segment 64 when the block 60 is along the straight backing bar 52.

The trailing segment 68 (FIG. 7) possesses an L-shaped configuration and has a side leg 92 and a cross leg 94, the latter of which is located behind the former and projects over the conveying channel 39. The cross leg 94 terminates at a recess 96 that is V-shaped or some other suitable configuration and is located generally at the centerline of the channel 39. The inside surfaces of the two legs 92 and 94 are planar and perpendicular to each other. These surfaces merge at a contoured corner 98, the radius of curvature for which equals that of the corner 6 on the container C. Moreover, the planar surface along the side leg 92 lies flush with the planar inside surface on the intermediate segment 64 when the block 60 is along a straight backing bar 52. The outside surface of the side leg 92 has a mounting tab 100 projected from it at the trailing end of that leg. Like the tabs 78 and 86, the tab 100 is equal in length to a single length of the captivator chain 50 and fits between the two chains which compose the dual chain 50, the tab 100 being secured to the chain 50 by pins 102 which hold the links of that chain 50 together. Thus, all links of the chain 50, except the one to which the tab 100 is attached are free to move relative to the trailing segment 68. Projected upwardly from the top surface of the side leg 92 is a guide boss 104 which is sized to fit into the guide channel 58 and has a tapered leading end to facilitate entry at the channel 58. The leading end of the side leg 92 is planar and practically abuts the planar trailing end of the single leg 84 on the intermediate segment 66 when the segment 66 and 68 are along a straight backing bar 52.

The segments 64, 66, and 68 for the blocks 62 on the other captivator chain 50 are practically identical to the segment 64, 66, and 68 of the block 60, the only distinctions being that they are reversals and that the cross legs 72 and 94 on the leading and trailing segments 64 and 68, respectively, have protrusions 106 (FIG. 6) instead of recesses 76 and 96. The protrusions 106 are configured to fit within and conform to the recesses 76 and 96, and when they do, the inside surfaces of the opposed cross legs 72 and 94 are flush.

Figure 9A:
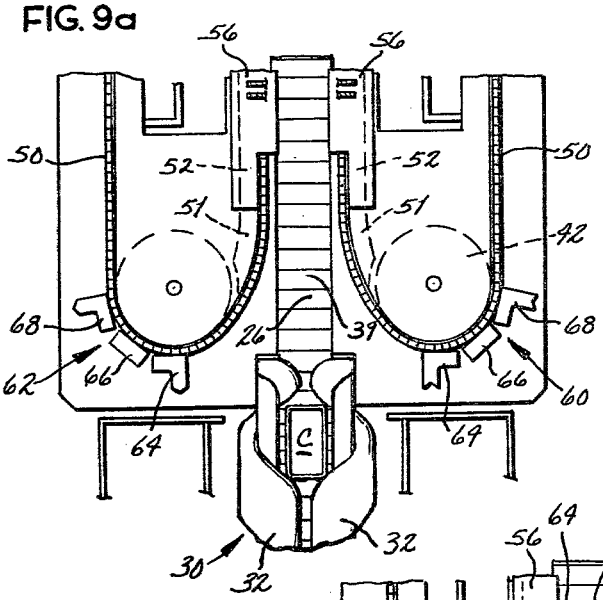
FIGS. 9A, 9B, and 9C are sequential plan views showing the feed end of the captivator mechanism as a pair of corresponding captivator blocks merge and close upon a container.
Figure 9B:
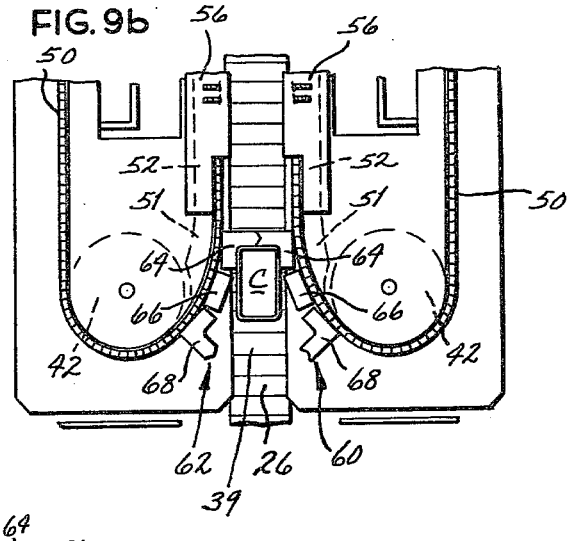
Figure 9C:
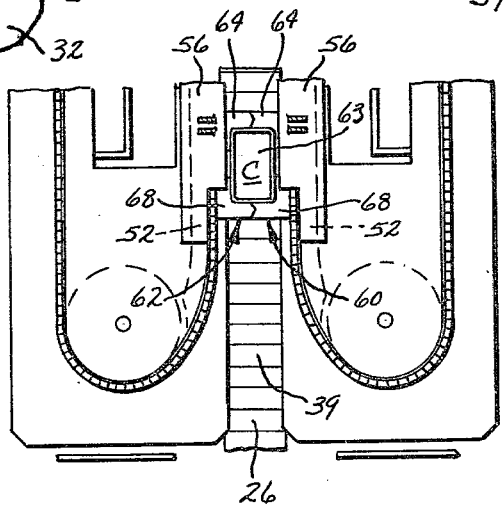

As previously mentioned, each block 60 on one captivator chain 50 corresponds with a block on the other chain 50 such that the corresponding blocks 60 and 62 merge when moving along the curved backing bars 51 (FIGS. 5 & 9). When a pair of corresponding blocks 60 and 62 is along the straight backing bars 52 (FIG. 9C), the cross legs 72 on the two leading segments 64 align and the V-shaped protrusion 106 of one fits into V-shaped recess 76 of the other to maintain this alignment. Similarily, the cross legs 94 of the trailing segments 68 align, with the V-shaped protrusion 106 of one fitting with the V-shaped recess 96 of the other so as to maintain the alignment. Moreover, as to each block 60 and 62 the side leg 70 of the leading segment 66, and the side leg 92 of the trailing segment 68 are all precisely aligned, and this alignment is insured by the disposition of the guide bosses 82, 90, and 104 in the guide channel 58 of the overlying guide plate 56. The planar inside surfaces on all of the segments 64, 66, and 68 together produces the rectangular cavity 63 between the blocks 60 and 62 and that cavity has corners defined by the contoured corners 74 and 98 on the leading and trailing segments 64 and 68. The cavity 63 has precisely the same configuration as the upper end of the container C. Hence, when the upper end of the container C is in the cavity 63, that upper end will assume its proper configuration, thus enabling a fitment ring R to be installed on it.

Located directly above the conveying channel 39 is a ring applicator 110 (FIGS. 1 & 4) which applies the fitment rings R to the containers C as they pass through the conveying channel 39, that is as they are gripped by the captivator blocks 60 and 62. The ring applicator 110 includes supporting legs 112 which straddle the main frame 20 and project upwardly through the base and cover plates 38 and 54 on each side of the main conveyor chain 26 and conveying channel 39. The legs 112 carry a lid delivery head 114 which has a delivery channel 116 (FIG. 4) that extends downwardly toward the chain 26. The head 114 is located just beyond the position where the opposed captivator blocks 60 and 62 first assume their completely closed positions. The delivery channel 116 is just wide and deep enough to accommodate a single ring R with its longitudinal axis extended upwardly. Mounted on the upper end of the delivery head 114 is a pair of double acting air cylinders 118, the piston rods of which align with and move through the delivery channel 116. Indeed, each piston rod if fitted with a presser finger 120, which, when its cylinder 118 is energized, move through the channel 116 and toward the main conveyor chain 26.

The ring applicator 110 further includes a ring supply trough 122 which is located above the conveyor chain 26 and is inclined downwardly at a slight angle toward the delivery head 114. The rings R are placed in the trough 122 with the flanges 10 projecting toward the delivery head 114. The leading ring R will move into the upper end of the delivery channel 116, in which case the lower portion of its flange 10 will be disposed adjacent to the presser finger 120 of one of the air cylinders 118. When that air cylinder 118 is energized, the presser finger 120 moves downwardly and drives the leading ring R through the delivery channel 116. The presser finger 120 of the other cylinder 118 retracts. When that air cylinder 118 is energized, its presser finger 120 engages the flange 10 on the second ring R and pushes the second lid R through the channel 116, and the second ring R turn drives the first ring R still further through channel 116, placing it in a position in which the lowermost portion of its flange 10 is out of the channel 116 and disposed slightly below the upper margins on the containers C which move along the main conveyor chain 26. In other words, the air cylinders 118 position the lower ends of the rings R in the path of the containers C moving through the conveying channel 36. Thus, two opposed captivator blocks 60 and 62 will bring a container C against a ring R which is projecting out of the delivery channel 116 of the head 114 so that the flange 10 of that ring R engages the upper end of the container C. Continued movement of the container C withdraws the engaged ring R from the delivery channel 116, and the ring R is placed onto the container C, covering the upper margin thereof. The operation of the ring applicator 110 is very similar to the lid applicator of U.S. Pat. No. 3,332,209.

Located immediately ahead of the delivery head 114 on the two guide plates 56 is a compression plate 123 (FIG. 4) that spans the guide channel 58 between the two plates 56. The spacing between the underface of the compression plate 123 and the flat top surface of the main conveyor chain 26 is slightly less than the vertical height for the containers C, so that each container C as it approaches the delivery head 114 and engages a fitment ring R therein is compressed to a predetermined height. That height presents the upper margin of the container C at precisely the elevation required for successful operation of the ring applicator 110. In this regard, the containers C vary slightly in height, perhaps as much as 1/32 inch. The compression plate 123 brings all containers C to the same height, for installation of the fitment ring R. The underface of the compression plate 123 is slightly beveled at its rearwardly presented end so that the containers C are guided smoothly beneath the plate 123 as they advance on the conveyor chain 26. Also the compression plate 123 is adjustable upwardly and downwardly.

Immediately beyond the delivery head 114 is a powered roller 124 which rotates on bearings mounted on the legs 112. The roller 124 is connected to the drive motor 28 for the main conveyor chain 26 and captivator chain 50, and its peripheral velocity is slightly less than the velocity of the captivator chains 50. After each lid L drops onto the upper edge of its container C, the container C is carried beneath the roller 124 which partially presses the lid L downwardly. Thereafter the containers C pass beneath a series of smaller compression rollers 126, the ends of which rotate freely in side plates 128 which are extended from the legs 112. The free wheeling compression rollers 126 force each ring R downwardly, causing the downwardly opening groove 14 to fully receive the upper edge of the container C.

OPERATION

The containers C are erected from paperboard blanks and may or may not be filled with a product prior to passage through the machine A where the fitment rings R are applied. In this regard, the fitment rings R rigidify the upper ends of the containers C and maintain them in a rectangular configuration corresponding to the lower ends of the containers C.

The erected containers C are placed on the feed end of the main conveyor 26 in a random manner, and the conveyor 26 advances the containers C to the end of the feed screws 32 where the containers C tend to accumulate one behind the other (FIG. 1). The feed screws 32 engage the containers C one at a time and each container C which is so engaged moves along the opposed roots of the rotating screws 32. Consequently, the screws 32 space the containers C and that spacing equals the distance between successive captivator blocks 60 or 62 on the captivator chains 50.

The feed screws 32 release the containers C onto the portion of the main conveyor chain 26 which is located generally between the two idler sprockets 42 that is, at the location where the captivator blocks 60 and 62 move from the outer passes of the chains 50 to the inner passes (FIG. 9*a*). The blocks 60 and 62 being segmented, open up as they pass around the idler sprockets 42 and furthermore remain open to a lesser extend beyond the idler sprockets 42 since at this location their chains 50 move along the curved backing bars 51. The chains 50 are synchronized with the lead screws 32 such that each container C released by the lead screws 32 into the space between a pair of opened captivator blocks 60 and 62 as those captivator blocks move away from the idler sprockets 42 and along the curved backing bars 51 (FIG. 9*b*).

As the container C and blocks 60 and 62 advance along the curved backing bars 51, the blocks 60 and 62 close upon the container C until the container C is snugly fitted between corresponding captivator blocks 60 and 62 on the two captivator chains 50 (FIG. 9*c*). More specifically, as the leading segments 64 of the two captivator blocks 60 and 62 approach the straight backing bars 52, the V-shaped projection 106 on the leading segment 64 for the captivator block 62 projects into the V-shaped recess 76 in the leading segments 64 for the block 60 and the side legs 72 of the two leading segments 64 approach a condition parallel to one another and to the straight backing bars 52 (FIG. 9*b*). The intermediate segments 66, however, are spaced apart, as are the trailing segments 68, and indeed the cross legs 94 of the trailing segments 68 are located at almost a 45° angle with respect to the direction of advance through the conveying channel 39. Continued advancement of the corresponding captivator blocks 60 and 62 on the chains 50 moves the intermediate segments 66 inwardly until they align with and form a straight continuation of the side legs 70 on the leading segments 64. Thereafter, the trailing segments 68 move inwardly, causing their side legs 92, to assume a straight-line continuation of the side legs 70 on the leading segments 64 and the straight legs 84 on the intermediate segments 66 (FIG. 9*c*). Also, the cross legs 94 of the trailing segments 68 move toward one another and clamp around the trailing end wall 4 of the container C. When the blocks 60 and 62 are fully closed they completely embrace the container C around its entire periphery. Moreover, the V-shaped projection 106 on the cross leg 94 of the trailing segment 68 for the block 62 is received in the V-shaped recess in the cross leg 94 for the trailing segment 68 of the block 60, thus keeping the blocks 60 and 62 perfectly aligned, even when the chains 50 wear unevenly.

Immediately after the leading segments 64 come to their respective straight backing bars 52, the guide bosses 82 of these segments enter the guide channels 58 on the plates 56, so that the leading segments 64 of the blocks 60 and 62 are rigidly confined in the lateral direction (FIG. 6). The guide bosses 90 and 104 of the intermediate and trailing segments 66 and 68 likewise enter the guide channel 58 so that when the blocks 60 and 62 are between the straight backing bars 52, all of the segments 64, 66, and 68 are positioned in the transverse direction by the guide channels 58. Furthermore, as previously noted the leading segments 64 of the two blocks 60 and 62 are maintained in alignment as a result of the projection 106 on the one being in the V-shaped recess 76 of the other. The same is true of the trailing segment 68, since the V-shaped projection 106 of one fits into the V-shaped recess 96 of the other. The individual segments 64, 66, and 68 of either block 60 or 62 cannot move longitudinally with respect to each other because they are attached firmly to their chains 50. Consequently the two blocks 60 and 62 and their respective segments 64, 66, and 68 are all maintained in fixed and determined relation to one another as the blocks 60 and 62 move along the portion of the conveying channel 39 between the straight backing bars 52, and this in turn maintains the cavity 63 formed by the blocks 60 and 62 in precisely the configuration desired for the upper end of the container C, which is captured between the blocks 60 and 62.

As the pair of corresponding blocks 60 and 62 merge and close around the container C the container C passes beneath the compression plate 123 where it is compressed slightly to a height suitable for installation of the fitment ring R. At about the same time the ring applicator 110 places a fitment ring R at the lower end of the delivery channel 116 in the delivery head 114, with the lowermost portion of that ring R being disposed in the path of the upper edge for the container C (FIG. 4). Continued advancement of the container C brings the upper margin on its leading end wall 4 into engagement with the lowermost portion of the flange 10 on the fitment ring R, and by this time the container C is snugly embraced by and confined in the closed blocks 60 and 62. The fitment ring R is drawn out of the channel 116 and placed over the upper margin of the container C. Since the container C fits snugly within the cavity 63 formed by the closed captivator blocks 60 and 62, the upper margin of the container C is maintained in a predetermined configuration, and that configuration corresponds precisely to the configuration of the downwardly opening groove 14 on the fitment ring R. Hence, the groove 14 receives the upper edge of the container C.

Thereafter, the container C and its overlying fitment ring R pass beneath the powered roller 124 which forces the ring R downwardly to insure that the upper ends of the side and end walls 2 and 4 are fully inserted within the groove 14. The compression rollers 126 aid in seating the ring R.

Beyond the compression rollers 126, the captivator blocks 60 and 62 diverge and release the container C so that it can be carried away by the main conveyor 26. Thereafter, the containers C may be filled, the lids 18 may be applied, or some other packaging step may take place. For example, a heat seal between the fitment ring and the upper margin of the container may be produced at another processing station located beyond the machine A.

The machine A is particularly useful for applying fitment rings R or other rigidifying devices to containers of the rectangular configuration. However, it may be used to apply lids or rings to circular containers as well, since it firmly grips the upper end of a flexible containers around its entire periphery and thereby brings the container into a predetermined configuration. In that case, the captivator blocks when closed would provide a circular cavity, but the blocks would still be segmented with the leading segments closing first and then succeeding segments. Moreover, the captivator blocks, whatever their configuration, need not be three segments, but may be of a number greater or less than three, three being used merely for purposes of illustration.

The machine A is suitable for applying fitment rings R or any other device, such as a lid, to a wall so as to rigidify the end of an otherwise flexible wall. Indeed, the machine A is useful for any operation which requires flexible container walls to be maintained in a predetermined configuration.

This invention is intended to cover all changes and modifications of the example of the invention herein chosen for purposes of the disclosure which do not constitute departures from the spirit and scope of the invention.

What is claimed is:

1. A machine for gripping a container having a flexible peripheral wall so as to maintain the peripheral wall in a predetermined configuration, said machine comprising: a base having a conveying path along it, with the conveying path having a feed end and a discharge end; a first endless conveying device on the base and having an inner pass located along one side of the conveying path and an outer pass located away from the conveying path; a second endless conveying device on the base and having an inner pass that is located along the other side of the conveying path and an outer pass located away from the conveying path; drive means for moving the endless devices at substantially the same velocity and such that the inner passes travel toward the discharge end of the path; and first and second captivator blocks on the first and second endless devices respectively, with each captivator block including a plurality of individual segments, one of which is a leading segment and another of which is a trailing segment, the captivator blocks and the endless devices being configured such that each captivator block approaches the inner pass of its endless device in an open condition and then moves into a closed condition as the block moves further into the inner pass, with corresponding first and second blocks merging as the blocks move into their closed positions, the individual segments of corresponding first and second blocks being spread apart when the blocks are in the open condition to enable the peripheral wall of a container to be loosely received between the blocks, and the individual segments being closer together when the blocks are in their closed condition to produce a cavity in which the flexible peripheral wall of the container will snugly fit, the leading segments for corresponding first and second blocks being located substantially against each other and the corresponding trailing segments also being located substantially against each other when the blocks are closed along the inner passes so that the cavity formed by corresponding first and second blocks is substantially continuous around the container, whereby the corresponding first and second blocks maintain the flexible peripheral wall of the container in a predetermined configuration.

2. A machine according to claim 1 wherein the leading segment of the first block has a recess which opens toward the corresponding second block when the first block is closed along the inner pass of its endless device and the leading segment of the second block has a projection which is received in the recess of the corresponding first block when the corresponding blocks are closed along their respective inner passes.

3. A machine according to claim 2 wherein the trailing segment of the first block has a relief which opens toward the corresponding second block when the first block is closed along the inner pass of its endless device; and the second block has a projection which is received in the relief of the first block when the blocks are closed along their respective inner passes.

4. A machine according to claim 3 wherein the reliefs and projections are V-shaped.

5. A machine according to claim 1 wherein the cavity formed by corresponding closed blocks along the inner passes of their respective endless devices is substantially rectangular.

6. A machine according to claim 1 and further comprising guides mounted on the base adjacent to the conveying path, and wherein the segments of the captivator blocks have means for engaging the guides as the blocks pass along the inner passes of their respective endless devices, whereby the blocks are precisely positioned in the lateral direction with respect to the conveying path.

7. A machine according to claim 6 wherein the guides include means defining guide channels alongside and parallel to the conveying path and the segments have bosses which projects into the guide channels.

8. A machine according to claim 1 wherein the conveying path comprises a main conveyor which moves over the base and is powered by the drive means at the same velocity as the endless devices.

9. A machine according to claim 8 and further comprising: spacing means for releasing containers onto the conveyor such that the containers so released locate between corresponding first and second blocks as those blocks merge and move from their open to their closed conditions.

10. A machine according to claim 9 wherein the spacing means includes at least one timing screw, the roots of which are large enough to receive the containers.

11. A machine according to claim 8 and further comprising means for applying rigidifying structures to the open ends of the containers while they are gripped snugly by the first and second captivator blocks along the conveying path.

12. A machine according to claim 11 and further comprising means on the base for compressing each container to a predetermined height when the rigidifying structure is applied to that container.

13. A machine according to claim 11 wherein each rigidifying structure has a downwardly opening groove configured to receive the upper margin of the container and the means for applying the rigidifying structures successively presents the rigidifying structures in a generally upright position, each with its lower end in the path of the leading end of a container, so that the groove at the lower end of the structure will receive the leading upper margin on the wall of the container, whereby the moving container will draw the rigidifying structure downwardly and cause it to fit over the upper margin of the container.

14. A machine according to claim 1 and further comprising a rotating wheel mounted on the base on each side of the conveying path and a curved backing bar mounted on the base and leading away from the wheel and toward the conveying path, the curvature of the backing bar being greater than the curvature of the wheel; and wherein the endless devices are extended around the wheels and along the curved backing bars leading away from those wheels with the transition from the outer passes to the inner passes occurring at the wheels.

15. A machine according to claim 14 wherein each endless device is a chain and each wheel is a sprocket that engages one of the chains.

16. A machine according to claim 14 and further comprising straight backing bars mounted on the base parallel to each other and the conveying path and forming continuations of the curved backing bars, the inner passes of the endless devices being against the straight backing bars.

17. A machine for installing a relatively rigid end structure such as a fitment ring on the open end of a container having flexible side walls which lead up to the open end, said machine comprising: a base; a main conveyor along the base for supporting a succession of containers in an upright position; front and rear sprockets on each side of the main conveyor; a captivator chain around each set of front and rear sprockets, each chain having an inner pass that passes along the main conveyor with the inner passes of the two chains having sections that are parallel; drive means for moving the main conveyor and for rotating at least one of the sprockets of each set such that the main conveyor and the two captivator chains move at substantially the same velocity and the inner passes of the chains travel in the same direction as the main conveyor; and captivator blocks on the captivator chains and being positioned such that corresponding blocks on each chain come around their respective rear sprockets together and thereafter close upon each other to produce a cavity capable of snugly receiving a single container, each captivator block including a plurality of individual segments which enable the blocks to open up as they come around the rear sprockets and to thereafter close down as they move away from the rear sprockets and into the parallel sections of the inner passes, whereby a container released onto the main conveyor as the corresponding captivator blocks come around the rear sprockets for their respective chains will at first be loosely gripped by the corresponding captivator blocks and will then be tightly gripped; and means for applying the rigid end structure to the upper ends of the containers as they are tightly gripped along the inner passes of the captivator chains.

18. A machine according to claim 17 wherein each segment of the captivator block is secured to its captivator chain independently of the other segments.

19. A machine according to claim 17 wherein each captivator block includes leading and trailing segments and the leading segments of corresponding blocks interfit as do the trailing segments.

20. A machine according to claim 17 wherein the base carries guide members having downwardly opening guide channels along the side of the main conveyor and the individual segments of the blocks have upwardly projecting bosses which fit into the guide channels as the blocks move along the inner passes of the captivator chains.

21. A machine according to claim 20 and further comprising a curved backing bar mounted on the base on each side of the main conveyor and leading from the rear sprocket to the main conveyor, the curved backing bars having a lesser radius of curvature than the rear sprockets and the inner passes of the chains being against the curved backing bars so as to assume the curvature of the curved backing bar, whereby the blocks begin to close along the curved backing bars.

* * * * *